US007171947B2

(12) United States Patent
Fukushima et al.

(10) Patent No.: US 7,171,947 B2
(45) Date of Patent: Feb. 6, 2007

(54) ELECTRICALLY-ACTUATED THROTTLE DEVICE FOR GENERAL-PURPOSE ENGINE

(75) Inventors: Tomoki Fukushima, Wako (JP); Yasuhide Ono, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/439,120

(22) Filed: May 24, 2006

(65) Prior Publication Data

US 2006/0266330 A1 Nov. 30, 2006

(30) Foreign Application Priority Data

May 27, 2005 (JP) ..... 2005-155023
May 27, 2005 (JP) ..... 2005-155024

(51) Int. Cl.
*F02D 41/06* (2006.01)

(52) U.S. Cl. ..... 123/399; 123/179.18; 123/438; 261/39.1; 261/DIG. 74

(58) Field of Classification Search ..... 123/179.16, 123/179.18, 361, 399, 438; 261/39.1, DIG. 74
See application file for complete search history.

(56) References Cited

U.S. PATENT DOCUMENTS

2005/0199217 A1* 9/2005 Kamimura et al. ..... 123/399
2005/0200030 A1* 9/2005 Kamimura et al. ..... 261/39.1
2005/0205039 A1* 9/2005 Kamimura et al. .... 123/179.18

FOREIGN PATENT DOCUMENTS

JP 04-116256 4/1992

* cited by examiner

*Primary Examiner*—T. M. Argenbright
(74) *Attorney, Agent, or Firm*—Westerman, Hattori, Daniels & Adrian, LLP.

(57) ABSTRACT

In an electrically-actuated throttle device for a general-purpose engine, supply of current to the throttle motor and choke motor for moving the throttle valve and choke valve is started when cranking is detected after activation (power-up) of the electronic control unit (ECU). In other words, supply of current is not started simultaneously with activation of the ECU but is delayed until cranking is detected. Owing to this configuration, no power of the battery is consumed unnecessarily between power-up and starting of the engine. Decrease in the power supplied to the starter motor is therefore prevented, thereby improving the starting performance of the engine. In addition, even if starting of the engine is not commenced after power-up, the battery is not likely to be excessively discharged.

11 Claims, 5 Drawing Sheets

ELECTRICALLY-ACTUATED THROTTLE DEVICE FOR GENERAL-PURPOSE ENGINE

BACKGROUND OF THE INVENTION

1. Field of the Invention

This invention relates to an electrically-actuated throttle device for a general-purpose engine.

2. Description of the Related Art

In recent years, electrically-actuated throttle devices have come to be applied to general-purpose internal combustion engines used as prime movers in generators, agricultural machines and various other equipment for regulating the speed (rpm) of the engine by utilizing an electrically-driven actuator to open and close a throttle valve installed in the air intake passage. Japanese Laid-Open Patent Application No. Hei 4(1992)-116256, for example, teaches an electrically-actuated throttle device that uses an electrically-driven actuator to open and close not only a throttle valve but also a choke valve.

Most electrically-actuated throttle devices use a stepper motor as the electrically-driven actuator. In such a case, the electrically-driven actuator has to be initialized before the control is commenced. Namely, processing needs to be conducted for setting the rotor (output shaft) of each stepper motor to the initial position, i.e., for setting the opening of the associated valve to the initial opening, usually fully closed or fully opened. Conventionally, this has been done when the operator powers up the machine, by simultaneously supplying current to the electrically-driven actuator and then carrying out the initialization processing.

However, supplying current to the electrically-driven actuator simultaneously with power-up degrades engine starting performance because heavy consumption of battery power occurs before the engine starts and this decreases the amount of power that can be supplied to the starter motor for starting the engine. And if the engine should not be started after power-on, the battery is liable to go dead or become excessively discharged faster than otherwise.

SUMMARY OF THE INVENTION

An object of this invention is therefore to overcome the foregoing drawbacks by providing an electrically-actuated throttle device for a general-purpose engine that utilizes an electrically-driven actuator to open and close a throttle valve and/or choke valve and is configured to avoid unnecessary consumption of battery power between engine power-up and engine starting.

In order to achieve the object, this invention provides an electrically-actuated throttle device for a general-purpose engine having a throttle valve and a choke valve both installed in an air intake passage and an electrically-driven actuator moving at least one of the throttle valve and the choke valve, comprising: an electronic control unit controlling current supply to the actuator to regulate an opening of at least one of the throttle valve and the choke valve; a main switch located to be operable by an operator and when turned on, activating the electronic control unit; and a power coil generating a pulse signal indicative of a rotating speed of the engine; wherein the electronic control unit starts the supply of current to the actuator when the engine is detected to be cranked from the pulse signal generated by the power coil after activated by the main switch by the operator.

BRIEF DESCRIPTION OF THE DRAWINGS

The above and other objects and advantages of the invention will be more apparent from the following description and drawings in which.

DETAILED DESCRIPTION OF THE PREFERRED EMBODIMENTS

An electrically-actuated throttle device for a general-purpose engine according to preferred embodiments of the present invention will now be explained with reference to the attached drawings.

Figure 1:
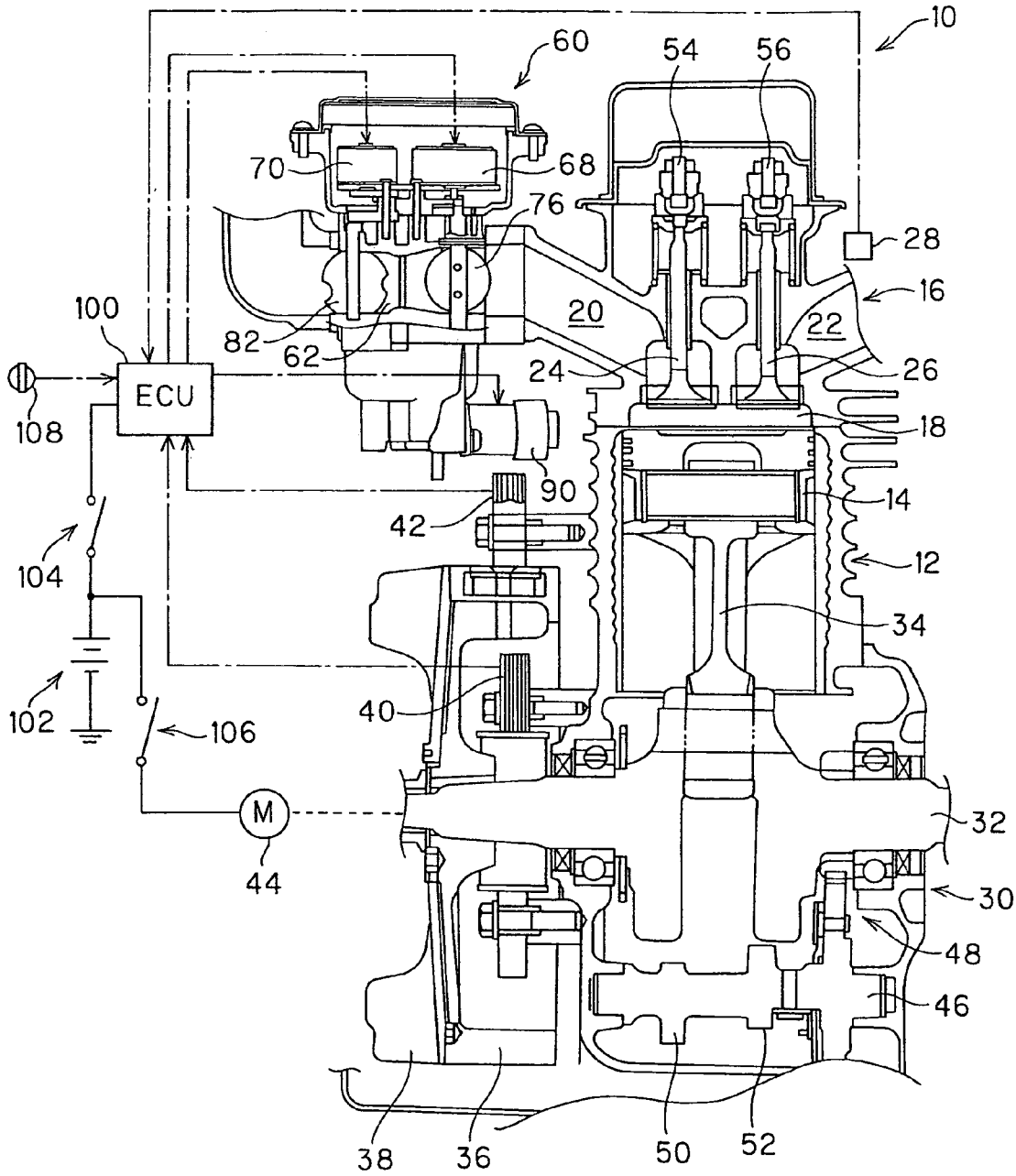
FIG. 1 is a diagram of the entire configuration of an electrically-actuated throttle device for a general-purpose engine according to a first embodiment of this invention.

FIG. 1 is a diagram of the entire configuration of an electrically-actuated throttle device for a general-purpose engine according to a first embodiment of this invention;

Reference numeral 10 in FIG. 1 designates a general-purpose engine. The engine 10 is a water-cooled, four-cycle, single-cylinder OHV model with a displacement of, for example, 400 cc. The engine 10 is suitable for use as the prime mover of a generator, agricultural machine or any of various other kinds of equipment.

The engine 10 has a cylinder (cylinder block) 12 accommodating a piston 14 that can reciprocate therein. A cylinder head 16 is attached to the top of the cylinder 12. A combustion chamber 18 is formed in the cylinder head 16 so as to face the crown of the piston 14. An intake port 20 and an exhaust port 22 are provided in communication with the combustion chamber 18. The cylinder head 16 is provided with an intake valve 24 for opening and closing communication between the combustion chamber 18 and the intake port 20, and an exhaust valve 26 for opening and closing communication between the combustion chamber 18 and the exhaust port 22. It is also provided with a temperature sensor 28 for producing an output indicating the temperature of the engine 10.

A crankcase 30 is attached to the bottom of the cylinder 12. A crankshaft 32 is installed in the crankcase 30 to be rotatable therein. The crankshaft 32 is connected to the bottom of the piston 14 through a connecting rod 34.

A generator or other load (not shown) is connected to one end of the crankshaft 32. A flywheel 36 and a cooling fan 38 are connected to the other end thereof. A power coil (generator coil) 40 is installed inside the flywheel 36 and a pulser coil 42 is installed outside the flywheel 36. The power coil 40 generates alternating current (pulse signal) of a frequency proportional to the rotating speed (rpm) of the crankshaft 32 and the pulser coil 42 outputs a pulse signal every predetermined crank angle. A starter motor 44 for starting the engine 10 is connected to the crankshaft 32.

A camshaft 46 is also installed in the crankcase 30 to be rotatable therein. The camshaft 46 is aligned in parallel with the axis of the crankshaft 32 and is connected to the crankshaft 32 through a gear mechanism 48. The camshaft 46 is equipped with an intake side cam 50 and an exhaust side cam 52, which operate through push rods (not shown) and rocker arms 54, 56 to open and close the intake valve 24 and exhaust valve 26.

A carburetor 60 is connected to the intake port 20.

Figure 2:
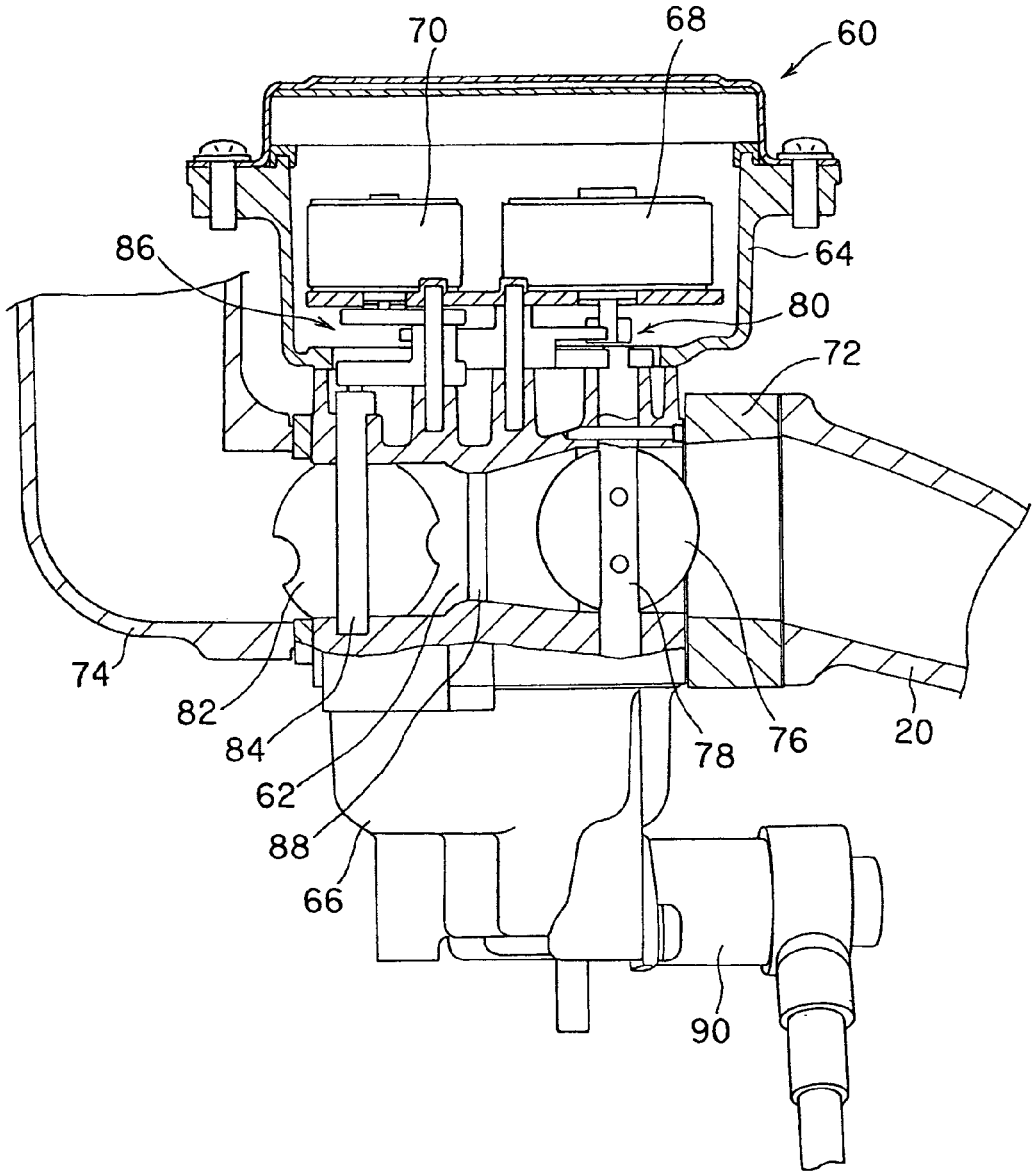
FIG. 2 is an enlarged sectional view of a carburetor shown in FIG. 1.

An enlarged sectional view of the carburetor 60 is shown in FIG. 2.

As shown in FIG. 2, the carburetor 60 unitarily comprises an air intake passage 62, motor case 64 and carburetor assembly 66. An electric throttle motor (electrically-driven actuator) 68 and electric choke motor (electrically-driven actuator) 70 are housed in the motor case 64. The throttle motor 68 and choke motor 70 are stepper motors each comprising a stator wound with a coil and a rotor (output shaft).

The downstream side of the air intake passage 62 is connected through an insulator 72 to the intake port 20, and the upstream side thereof is connected through an air-cleaner elbow 74 to an air-cleaner (not shown).

A throttle valve 76 is installed in the air intake passage 62. The rotational shaft 78 of the throttle valve 76 is connected through a reduction gear mechanism 80 to the output shaft of the throttle motor 68. A choke valve 82 is installed in the air intake passage 62 on the upstream side of the throttle valve 76. The rotational shaft 84 of the choke valve 82 is connected through a reduction gear mechanism 86 to the output shaft of the choke motor 70. The openings of the throttle valve 76 and choke valve 82 can therefore be independently or separately regulated by controlling the operation of the throttle motor 68 and choke motor 70. The throttle motor 68 and choke motor 70 consume about 0.8 A of current each.

The air intake passage 62 is reduced in diameter between the throttle valve (plate) 76 and choke valve 82 to form a venturi 88.

Although not shown in the drawings, the carburetor assembly 66 comprises a float chamber connected to a fuel tank, a main nozzle connected to the float chamber through a main jet and a main fuel line, and an idle port and a slow port connected to a slow fuel line branching from the main fuel line. The main nozzle is installed at a position where it faces into the venturi 88. The idle port and slow port are installed at positions where they face into the vicinity of the throttle valve 76.

When the opening of the throttle valve 76 is large, fuel is jetted from the main nozzle owing to the negative pressure of the intake air passing through the venturi 88, thereby producing an air-fuel mixture. When the opening of the throttle valve 76 is small, fuel is jetted from the idle port and/or the slow port owing to the negative pressure of the intake air passing through the throttle valve 76. When the choke valve 82 is closed, the negative pressure in the air intake passage 62 is increased by the descending stroke of the piston 14, thereby increasing the amount of jetted fuel and producing a rich air-fuel ratio.

Reference numeral 90 in FIG. 2 designates a fuel-cut solenoid valve. The valve member (not shown) of the fuel-cut solenoid valve 90 is installed between the float chamber and main jet. When the coil (not shown) of the fuel-cut solenoid valve 90 is energized, the valve member closes to block passage of fuel.

The explanation of FIG. 1 will be resumed. The air-fuel mixture produced in the foregoing manner passes through the intake port 20 and intake valve 24 to be sucked into the combustion chamber 18. The air-fuel mixture sucked into the combustion chamber 18 is ignited by a spark plug (not shown) and burns. The resulting combustion gas is discharged to outside the engine 10 through the exhaust port 22, a muffler (not shown) and the like.

An ECU (Electronic Control Unit) 100, constituted as a microcomputer, and a battery 102 are installed near the engine 10. The ECU 100 and battery 102 are in electrically connected through a main switch 104. The main switch 104 is located to be operable by the operator. When operated, it activates the ECU 100. That is, when the operator turns on the main switch 104, the ECU 100 is brought into electrical continuity with the battery 102 and activated by current supplied from the battery 102. When the main switch 104 is turned off, the supply of current from the battery 102 is cut off and the operation of the ECU 100 is terminated. The ECU 100 consumes about 0.1 A of electric current.

A starter switch 106 and an engine speed-setting switch 108 are installed near the main switch 104. The starter switch 106 is located to be operable by the operator. When operated, it operates the starter motor 44. That is, so long as the operator keeps the starter switch 106 on, the starter motor 44 is maintained in electrical continuity with and supplied with electric current from the battery 102. The starter motor 44 therefore operates to crank the engine 10. The engine speed-setting switch 108 is also located to be operable by the operator and responds to operation by producing an output indicating the desired engine speed inputted by the operator.

The outputs of the aforesaid temperature sensor 28, power coil 40, pulser coil 42 and engine speed-setting switch 108 are sent to the ECU 100. The ac output of the power coil 40 is applied to a bridge circuit (not shown) provided in the ECU 100 to be converted into direct current by full-wave rectification. The resulting direct current is supplied throughout the engine 10 as operating current. The source of operating current for the ECU 100 is switched from the battery 102 to the power coil 40 after the engine 10 starts. Therefore, even when the main switch 104 is turned off after the engine 10 starts, the operation of the ECU 100, motors 68, 70, fuel-cut solenoid valve 90 and the like can be continued until the crankshaft 32 stops rotating (i.e., the power coil 40 stops generating electricity).

The output of the power coil 40 is also applied to a pulse generating circuit (not shown) provided inside the ECU 100, where it is first half-wave rectified and then converted to a pulse signal having a threshold value of a suitable value. The frequency of the alternating current generated by the power coil 40 is proportional to the rotating speed (rpm) of the crankshaft 32. The pulse signal obtained from the output of the power coil 40 can therefore be used to determine the engine speed (rpm) and also to detect whether cranking is being conducted.

The ECU 100 ignites the spark plug at timing dependent on the engine speed determined from the output (pulse signal) of the pulser coil 42. Further, the ECU 100 control the operation of the throttle motor 68 and choke motor 70 and thus regulate the openings of the throttle valve 76 and choke valve 82 based on the outputs of the temperature sensor 28 and engine speed-setting switch 108. Thus, the throttle motor 68, choke motor 70, ECU 100 and the like constitute an electrically-actuated throttle device and the speed of the engine 10 is regulated by this electrically-actuated throttle device.

In addition, based on the pulse signal obtained from the output of the power coil 40, the ECU 100 carries out processing for initializing the openings of the throttle valve 76 and choke valve 82, namely processing for setting the rotors of the throttle motor 68 and choke motor 70 to their initial positions so as to set the openings of the valves to their initial openings.

Figure 3:
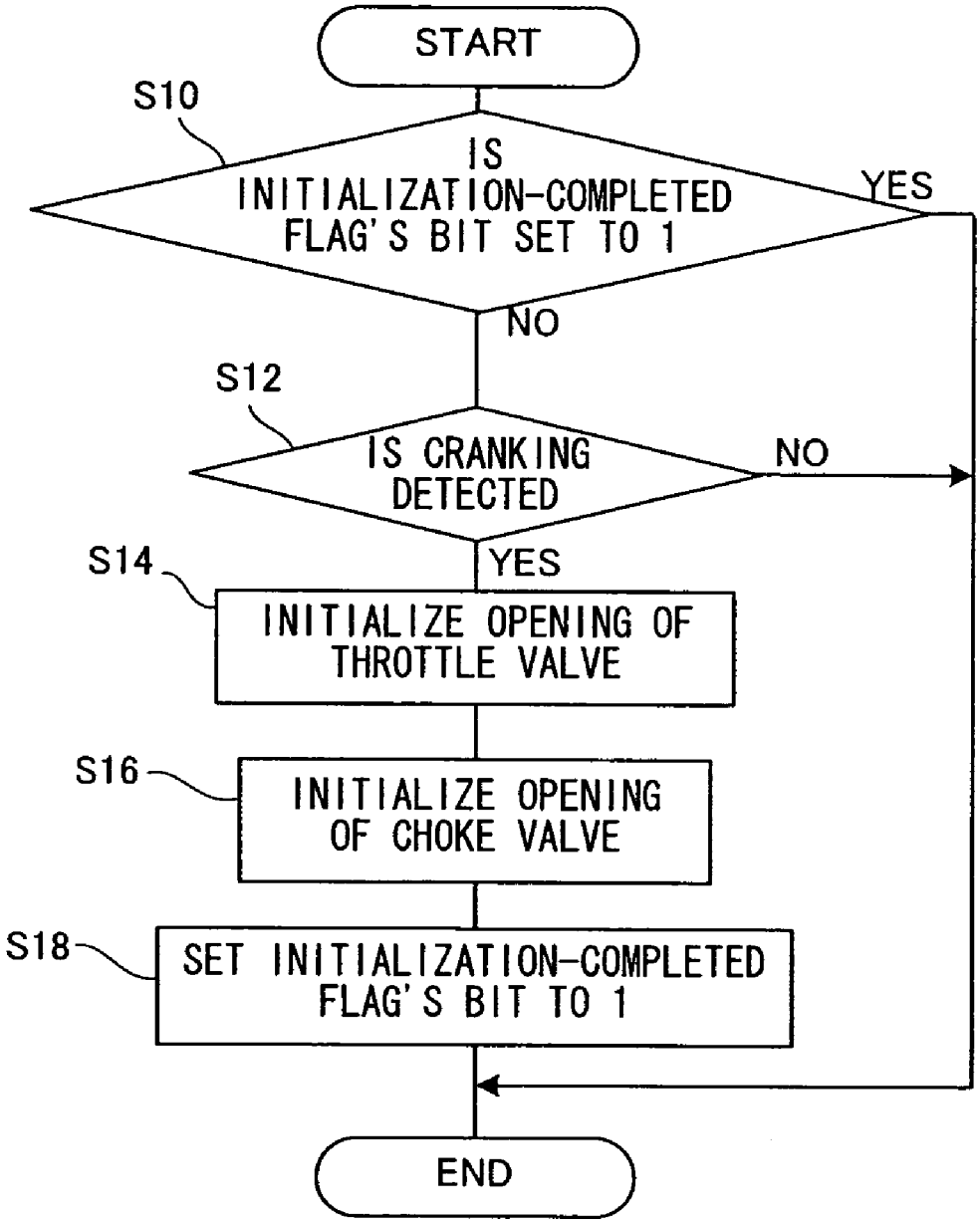
FIG. 3 is a flowchart showing the sequence of processing operations for initializing the openings of a throttle valve and choke valve executed by an electronic control unit shown in FIG. 1.

FIG. 3 is a flowchart showing the sequence of processing operations for initializing the openings of the throttle valve 76 and choke valve 82. The illustrated program is executed at regular intervals (e.g., every 10 milliseconds).

First, in S10, it is determined whether the bit of an initialization-completed flag (initial value 0) is set to 1. When the result in S10 is NO, the program goes to S12, in which it is determined whether cranking is detected, i.e., whether or not the operator operated the starter switch 106 to activate the starter motor 44 and start cranking. This determination is made based on the presence/absence of the pulse signal obtained from the output of the power coil 40.

When the result in S12 is YES (pulse signal input is present), the program goes to S14, in which the opening of the throttle valve 76 is initialized. Specifically, supply of current to the throttle motor 68 is started to fully open the throttle valve 76, whereafter the motor step position at this time is stored in a RAM (not shown) of the ECU 100 as the initial position. Next, in S16, the opening of the choke valve 82 is similarly initialized. Specifically, supply of current to the choke motor 70 is started to fully close the choke valve 82, whereafter the motor step position at this time is stored in the RAM of the ECU 100 as the initial position.

Next, in S18, the bit of the initialization-completed flag is set to 1. Therefore, once valve opening initialization has been completed, the result in S10 becomes YES in the next program cycle and S12 to S18 are skipped.

When the result in S12 is NO, the remaining steps are skipped. Even after the ECU 100 is activated, therefore, supply of current to the throttle motor 68 and choke motor 70 is not started insofar as cranking is not started.

Thus in the electrically-actuated throttle device for a general-purpose engine according to the first embodiment of the invention, supply of current to the throttle motor 68 and choke motor 70 for moving, i.e., opening/closing the throttle valve 76 and choke valve 82 is started when cranking is detected after activation of the ECU 100 (power-up). In other words, supply of current is not started simultaneously with activation of the ECU 100 but is delayed until cranking is detected. Owing to this configuration, no power of the battery 102 is consumed unnecessarily between power-up and starting of the engine 10 (the start of cranking). Decrease in the power supplied to the starter motor 44 is therefore prevented, thereby improving the starting performance of the engine 10. In addition, even if starting (cranking) of the engine 10 is not commenced after power-up, the battery is not likely to be excessively discharged.

This effect of the invention will be explained more concretely. As mentioned above, the throttle motor 68 and choke motor 70 consumes 0.8 A of current each and the ECU 100 consumes 0.1 A of current. Therefore, if supply of current to the motors should be started simultaneously with power-up as in the prior art, a total of 1.7 A of current would be continuously drawn up to the start of cranking. In contrast, the electrically-actuated throttle device of this embodiment consumes very little current during the same period, namely only the 0.1 A of current for operating the ECU 100. Consumption of battery power is therefore minimized.

The processing performed for opening/closing the throttle valve 76 and choke valve 82 when cranking is detected is initialization processing for regulating the openings of the valves to the initial openings. Therefore, once engine starting has commenced, the valve openings can be made equal to the desired openings with good accuracy.

Next, an electrically-actuated throttle device for a general-purpose engine according to a second embodiment of the present invention will now be explained.

In the second embodiment, a control for opening the choke valve 82 will be discussed.

Figure 4:
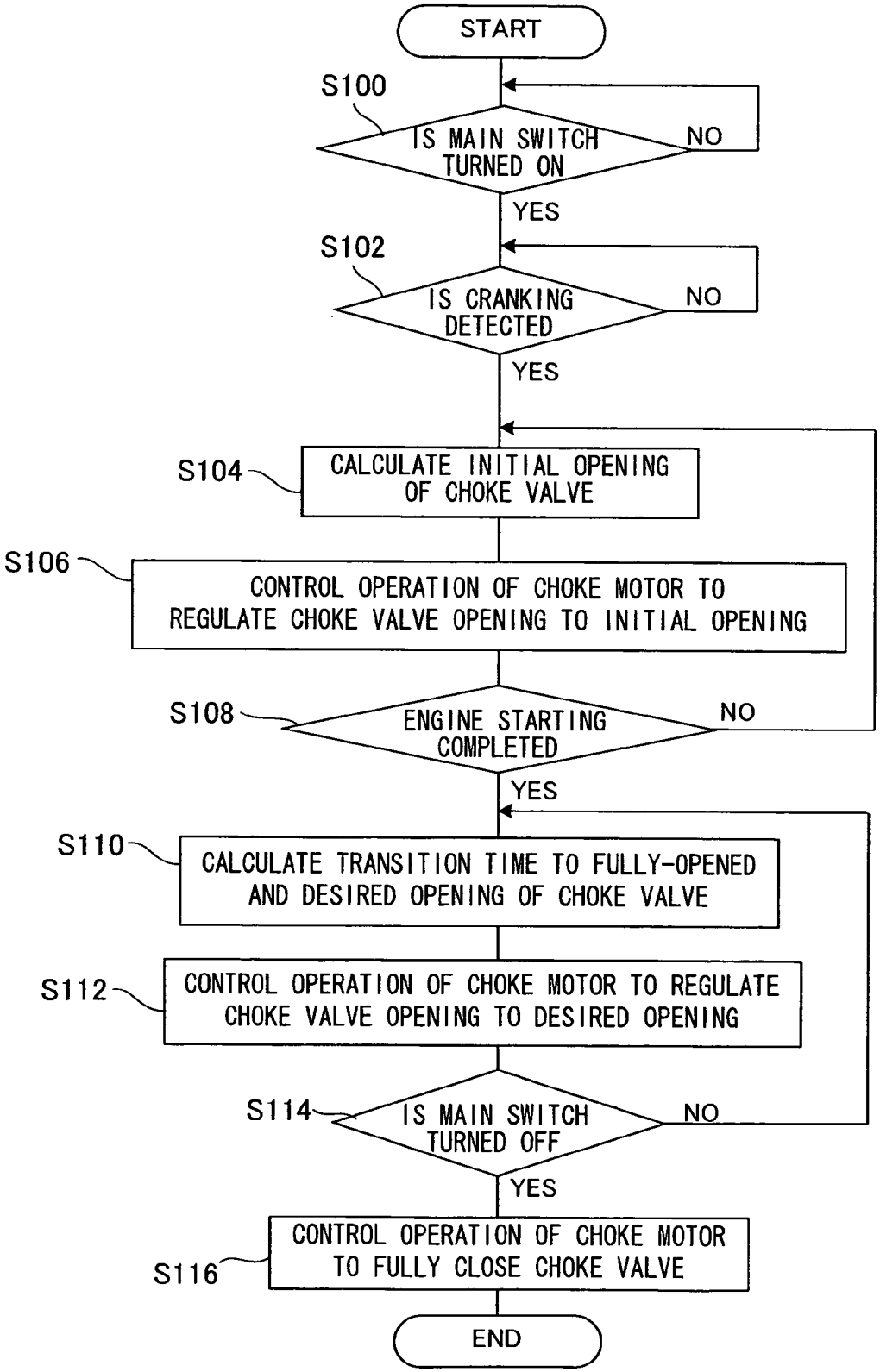
FIG. 4 is a flowchart showing the sequence of processing operations for controlling the opening of the choke valve executed by the electronic control unit shown in FIG. 1.

FIG. 4 is a flowchart showing the sequence of processing operations for conducting the control. The illustrated program is executed when the ECU 100 is activated.

First, in S100, it is determined whether the main switch 104 is turned on, i.e., whether the ECU 100 is in electrical continuity with the battery 102. The result in S100 is normally YES because the ECU 100 is brought into continuity with the battery 102 and supplied with operating current before engine starting.

Next, in S102, it is determined whether cranking is detected, i.e., whether or not the operator operated the starter switch 106 to activate the starter motor 44 and start cranking. This check is made based on the presence/absence of the pulse signal obtained from the output of the power coil 40.

When the result in S102 is YES (pulse signal being received), the program goes to S104, in which the initial opening of the choke valve 82 is calculated based on the output of the temperature sensor 28 (the temperature of the engine 10). The value of the initial opening is set larger with decreasing temperature of the engine 10. When the result in S100 or S102 is NO, the corresponding step is executed again.

Next, the program goes to S106, in which the operation of the choke motor 70 is controlled to regulate the opening of the choke valve 82 to the aforesaid initial opening, and then to S108, in which it is determined whether starting of the engine 10 has been completed. The determination of S108 is made by checking whether the speed of the engine 10 has reached normal combustion speed (e.g., 1,000 rpm).

Figure 5:
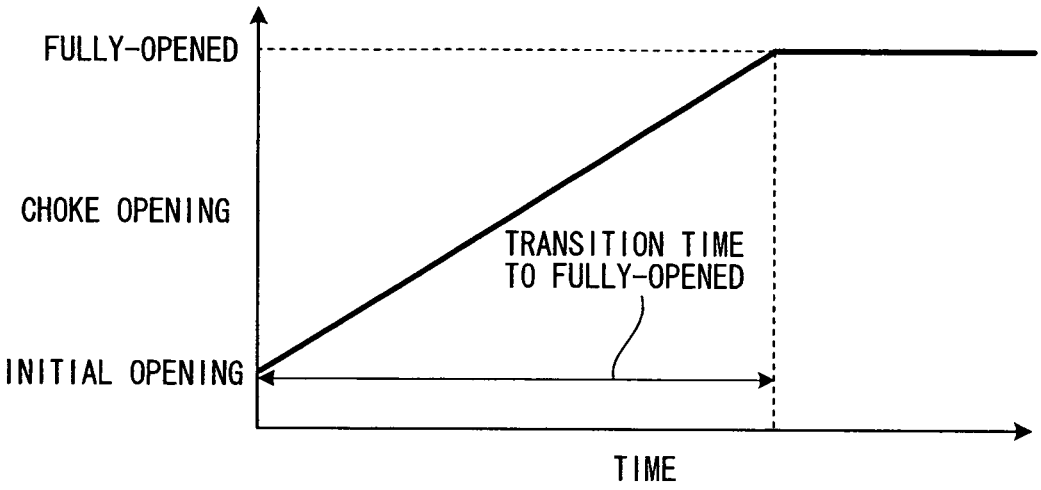
FIG. 5 is an explanatory view showing transition time to fully-opened used in the processing of the flowchart of FIG. 4.

When the result in S108 is NO, steps S104 and S106 are executed again. When it is YES, the program goes to S110, in which a transition time to fully-opened and the desired opening of the choke valve 82 are calculated. As shown in FIG. 5, the transition time to fully-opened is the time (period) required for the opening of the choke valve 82, i.e., choke opening to go from the initial opening (current opening) to the fully-opened state (e.g., 72°) and is determined or defined based on the output of the temperature sensor 28. The transition time to fully-opened is determined or set longer with decreasing temperature of the engine 10. The value of the desired opening in the current cycle is determined or defined so as to gradually open the choke valve 82 from the initial opening to fully-opened over the defined transition time.

Next, in S112, the operation of the choke motor 70 is controlled to regulate the opening of the choke valve 82 to the desired opening. Then, in S114, it is determined whether the main switch 104 has been turned off, i.e., whether the electrical continuity between the ECU 100 and the battery 102 has been cut off. When the result in S114 is NO, steps S110 and S112 are executed again. When the engine 10 is thoroughly warmed up, the transition time to fully-opened is defined as zero and, accordingly, the desired opening is defined as fully-opened.

When the result in S114 is YES, i.e., when the main switch 104 has been turned off, the program goes to S116, in which the operation of the choke motor 70 is controlled to fully close the opening of the choke valve 82. In addition, another routine (not shown) is executed when the main switch 104 has been turned off. This routine cuts off ignition by grounding the interconnection between the ignition circuit and the ignition coil (neither shown) and cuts off fuel supply by energizing the fuel-cut solenoid valve 90, thereby stopping the engine 10. Furthermore, the operation of the throttle motor 68 is controlled to fully open the throttle valve 76.

When the main switch 104 is turned off, the electrical continuity between the ECU 100 and the battery 102 is cut off. However, as explained earlier, the operation of the ECU 100, motors 68, 70, fuel-cut solenoid valve 90 and the like can be continued until the crankshaft 32 stops rotating (i.e., the power coil 40 stops generating electricity).

As stated, the ECU 100 controls operation of the choke motor 70 to fully close the choke valve 82 when the main switch 104 is turned off by the operator. Specifically, the second embodiment of the invention provides an electrically-actuated throttle device for a general-purpose engine (the engine 10) equipped with the choke valve 82 installed in the air intake passage 62, the actuator (choke motor 70) for moving the choke valve 82, and the electronic control unit (ECU 100) for controlling the operation of the actuator 70 to move the choke valve 82, which electrically-actuated throttle device for a general-purpose engine is configured so that when the engine 10 is stopped, i.e., the main switch 104 is turned off, the electronic control unit controls the operation of the actuator 70 to fully close the choke valve 82 (S114, S116 of the flowchart of FIG. 4).

In the prior art, the actuator is operated to fully close the choke valve at engine starting (after the processing of S100 or S102 in the flowchart of FIG. 4). This is liable to degrade engine starting performance because a certain amount of time is required for the choke valve to fully close after the start of engine cranking.

In contrast, the electrically-actuated throttle device for a general-purpose engine according to the present invention is configured to operate the choke motor 70 to fully close the choke valve 82 when the engine 10 is stopped. Engine starting performance is therefore improved by eliminating time lost for fully closing the choke valve at engine starting. In addition, engine starting performance is still further improved by fully opening the throttle valve 76 when the engine 10 is stopped.

As mentioned above, the first embodiment is configured to have an electrically-actuated throttle device for a general-purpose engine (10) having a throttle valve (76) and a choke valve (82) both installed in an air intake passage (62) and an electrically-driven actuator (electric throttle motor 68; electric choke motor 70) moving at least one of the throttle valve and the choke valve, comprising: an electronic control unit (ECU 100) controlling current supply to the actuator to regulate an opening of at least one of the throttle valve and the choke valve; a main switch (104) located to be operable by an operator and when turned on, activating the electronic control unit; and a power coil (40) generating a pulse signal indicative of a rotating speed of the engine; wherein the electronic control unit starts the supply of current to the actuator when the engine is detected to be cranked from the pulse signal generated by the power coil after activated by the main switch by the operator.

In the first embodiment, both the throttle valve (76) and the choke valve (82) are opened and closed by the electrically-driven actuators. However, the configuration according to this invention can also be applied to an electrically-actuated throttle device which opens and closes only one of the valves using an electrically-driven actuator. This is expressed by the phrase, "at least one of the throttle valve and the choke valve."

In the device, the electronic control unit (ECU 100) starts the supply of current to the actuator when the engine is detected to be cranked after activated (S12) to initialize an opening of at least one of the throttle valve (76) and the choke valve (82) (S14, S16).

In the device, the actuator (68, 70) is a stepper motor.

In the device, the electronic control unit (ECU 100) starts the supply of current to the stepper motor when the engine is detected to be cranked after activated to initialize an opening of the throttle valve (76) by fully opening the throttle valve and by storing a position of the stepper motor (68) at that time in a memory (RAM) as an initial position (S14).

In the device, the electronic control unit (ECU 100) starts the supply of current to the stepper motor when the engine is detected to be cranked after activated to initialize an opening of the choke valve (82) by fully closing the choke valve and by storing a position of the stepper motor (70) at that time in a memory (RAM) as an initial position (S16).

The second embodiment is configured such that the electronic control unit (ECU 100) controls operation of the actuator to fully close the choke valve (82) when the main switch (104) is turned off by the operator (S114, S116).

In the device, the electronic control unit (ECU 100) controls operation of the actuator to move the choke valve (82) to an initial opening determined from a temperature of the engine when the engine is detected to be cranked after activated (S102, S104). The initial opening is determined to be increased with decreasing temperature of the engine.

In the device, the electronic control unit (ECU 100) determines a transition time to fully-opened based on a temperature of the engine when the engine is detected to be started (S108, S110). The transition time is determined to be decreased with decreasing temperature of the engine.

In the device, the electronic control unit (ECU 100) determines a desired opening such that it gradually increases from the initial opening to fully-opened over the transition time.

Although stepper motors are used as the electrically-driven actuators in the first and second embodiments, it is possible instead to use electric motors of another type, magnetic solenoids or hydraulic devices operated by a pump driven by an electric motor. Although cranking is detected based on the pulse signal obtained from the output of the power coil 40 in the foregoing embodiments, it can instead be detected based on the output of the pulser coil or based on operation of the starter switch 106.

Japanese Patent Application Nos. 2005-155023 and 2005-155024 filed on May 27, 2005 are incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An electrically-actuated throttle device for a general-purpose engine having a throttle valve and a choke valve both installed in an air intake passage and an electrically-driven actuator moving at least one of the throttle valve and the choke valve, comprising:

an electronic control unit controlling current supply to the actuator to regulate an opening of at least one of the throttle valve and the choke valve;

a main switch located to be operable by an operator and when turned on, activating the electronic control unit; and a power coil generating a pulse signal indicative of a rotating speed of the engine;

wherein the electronic control unit starts the supply of current to the actuator when the engine is detected to be cranked from the pulse signal generated by the power coil after activated by the main switch by the operator.

2. The device according to claim 1, wherein the electronic control unit starts the supply of current to the actuator when the engine is detected to be cranked after activated to initialize an opening of at least one of the throttle valve and the choke valve.

3. The device according to claim 2, wherein the actuator is a stepper motor.

4. The device according to claim 3, wherein the electronic control unit starts the supply of current to the stepper motor when the engine is detected to be cranked after activated to initialize an opening of the throttle valve by fully opening the throttle valve and by storing a position of the stepper motor at that time in a memory as an initial position.

5. The device according to claim 3, wherein the electronic control unit starts the supply of current to the stepper motor when the engine is detected to be cranked after activated to initialize an opening of the choke valve by fully closing the choke valve and by storing a position of the stepper motor at that time in a memory as an initial position.

6. The device according to claim 1, wherein the electronic control unit controls operation of the actuator to fully close the choke valve when the main switch is turned off by the operator.

7. The device according to claim 6, wherein the electronic control unit controls operation of the actuator to move the choke valve to an initial opening determined from a temperature of the engine when the engine is detected to be cranked after activated.

8. The device according to claim 7, wherein the initial opening is determined to be increased with decreasing temperature of the engine.

9. The device according to claim 6, wherein the electronic control unit determines a transition time to fully-opened based on a temperature of the engine when the engine is detected to be started.

10. The device according to claim 9, wherein the transition time is determined to be decreased with decreasing temperature of the engine.

11. The device according to claim 9, wherein the electronic control unit determines a desired opening such that it gradually increases from the initial opening to fully-opened over the transition time.

* * * * *